US008434190B2

(12) United States Patent
Stief et al.

(10) Patent No.: US 8,434,190 B2
(45) Date of Patent: May 7, 2013

(54) TOOTHBRUSH AND METHOD OF MANUFACTURING IT

(75) Inventors: Christian Stief, Frankfurt am Main (DE); Martin Haas, Frankfurt am Main (DE); Jens Stoerkel, Frankfurt am Main (DE); Florian Stich, Weinheim (DE); Ulrich Pfeifer, Muenzenberg (DE)

(73) Assignee: BRAUN GmbH, Kronberg (DE)

( * ) Notice: Subject to any disclaimer, the term of this patent is extended or adjusted under 35 U.S.C. 154(b) by 336 days.

(21) Appl. No.: 12/853,576

(22) Filed: Aug. 10, 2010

(65) Prior Publication Data

US 2010/0313373 A1 Dec. 16, 2010

Related U.S. Application Data

(63) Continuation-in-part of application No. PCT/US2009/053813, filed on Sep. 1, 2009.

(30) Foreign Application Priority Data

Sep. 1, 2008 (EP) ..... 08015420

(51) Int. Cl.
*A46B 9/04* (2006.01)

(52) U.S. Cl.
USPC ..... 15/191.1; 15/186; 15/207.2; 15/190; 15/167.1; D4/105; 300/21

(58) Field of Classification Search ..... 15/21.1, 15/167.1, 167.2, 110–111, 185–188, 201–203, 15/194, 22.1, 191.1, 207.2, 190, 169; 300/21; D4/104–105
See application file for complete search history.

(56) References Cited

U.S. PATENT DOCUMENTS

| | | | | |
|---|---|---|---|---|
| 1,828,422 | A * | 10/1931 | Levy | 15/190 |
| 3,229,318 | A | 1/1966 | Clemens | |
| 5,802,656 | A * | 9/1998 | Dawson et al. | 15/110 |
| 6,138,315 | A | 10/2000 | Schmitt et al. | |

(Continued)

FOREIGN PATENT DOCUMENTS

| | | | |
|---|---|---|---|
| DE | 102 21 786 | A1 | 11/2003 |
| DE | 10 2004 020 706 | A1 | 11/2005 |
| WO | WO 2006/050039 | A1 | 5/2006 |
| WO | WO 2008/059435 | A1 | 5/2008 |

OTHER PUBLICATIONS

PCT International Search Report dated Mar. 5, 2010.

*Primary Examiner* — Jeanette E. Chapman
(74) *Attorney, Agent, or Firm* — Vladimir Vitenberg; David M. Weirich

(57) ABSTRACT

A toothbrush having a handle portion and a neck portion connecting the handle portion with a head. The head has a brushing side and a rear side. The brushing side includes a plurality of bristle tufts for cleaning the teeth. The tufts are attachable in the head through tufting apertures, with each tufting aperture being assigned a blind-end hole having side-walls and a bottom. The cross-sectional area of the head between a first bottom and the rear side differing from a cross-sectional area of the head between a second bottom and the rear side. The first bottom and the second bottom are arranged in the head in such a way that the minimum distance between the first bottom and the rear side as well as the minimum distance between the second bottom and the rear side are each in the range of between about 0.5 and about 2.5 mm.

12 Claims, 2 Drawing Sheets

U.S. PATENT DOCUMENTS

| | | | | |
|---|---|---|---|---|
| 7,445,295 | B2 * | 11/2008 | Fischer et al. | 300/21 |
| 7,814,606 | B2 * | 10/2010 | Storkel et al. | 15/167.1 |
| 7,975,344 | B2 * | 7/2011 | Braun et al. | 15/110 |
| 8,042,217 | B2 * | 10/2011 | Sorrentino | 15/167.1 |
| 2004/0010870 | A1 * | 1/2004 | McNair | 15/22.1 |
| 2004/0019990 | A1 | 2/2004 | Farrell et al. | |
| 2004/0128784 | A1 * | 7/2004 | Ben-Ari | 15/167.1 |
| 2007/0033757 | A1 * | 2/2007 | Storkel et al. | 15/167.1 |
| 2007/0271717 | A1 | 11/2007 | Clos et al. | |
| 2010/0088836 | A1 * | 4/2010 | Kirchhofer et al. | 15/167.1 |

* cited by examiner

A - A

B - B

TOOTHBRUSH AND METHOD OF MANUFACTURING IT

CROSS REFERENCE TO RELATED APPLICATION

This application is a continuation-in-part application of prior copending International Application No. PCT/US2009/053813, filed Sep. 1, 2009, designating the United States.

FIELD OF THE INVENTION

This invention relates to a toothbrush and a method of manufacturing a toothbrush.

BACKGROUND OF THE INVENTION

Today, the increasing functional demands placed on a toothbrush head often make it necessary to provide head geometries which, owing to their complex inner structure, are difficult to produce by injection molding. During the injection molding process the plastic material flowing into the die for molding the head is exposed to turbulence between the various tufting holes and other recesses or cavities of the molding and therefore flows very unevenly, particularly to undercuts or more complex structures lying farther away from the injection point. This problem is aggravated as soon as plastic materials are used for the head which exhibit greater shrinkage on cooling subsequent to the injection molding process. Depending on the inner structure of the head, visual faults or sunk spots, in particular also on the rear side of the head, are the undesired consequence.

It would be desirable to provide a toothbrush which has a complex inner structure within the head that has a visually pleasing rear side. It would also be desirable to provide a suitable method to make such a toothbrush.

Further advantages and application possibilities of the present invention will become apparent from the subsequent description of embodiments with reference to the accompanying drawing. It will be appreciated that any feature described and/or represented by illustration, when used singularly or in any meaningful combination, forms the subject matter of the present invention, irrespective of their summary in the claims or their back-reference.

SUMMARY OF THE INVENTION

A toothbrush that has a handle portion and a neck portion connecting the handle portion with a head. The head has a brushing side and a rear side opposite thereto. The brushing side includes a plurality of bristle tufts for cleaning the teeth. The tufts are attachable in the head through tufting apertures using an anchor. Each tufting aperture is assigned a blind-end hole having sidewalls and a bottom, wherein provision is made for a chamfer or radius in the transition area between the bottom and the sidewalls, with a cross-sectional area of the head between a first bottom and the rear side differing from a cross-sectional area of the head between a second bottom and the rear side. The first bottom and the second bottom are arranged in the head in such a way that the minimum distance y between the first bottom and the rear side as well as the minimum distance x between the second bottom and the rear side are each in the range is between about 0.5 and about 2.5 mm.

DETAILED DESCRIPTION OF THE INVENTION

Figure 1:
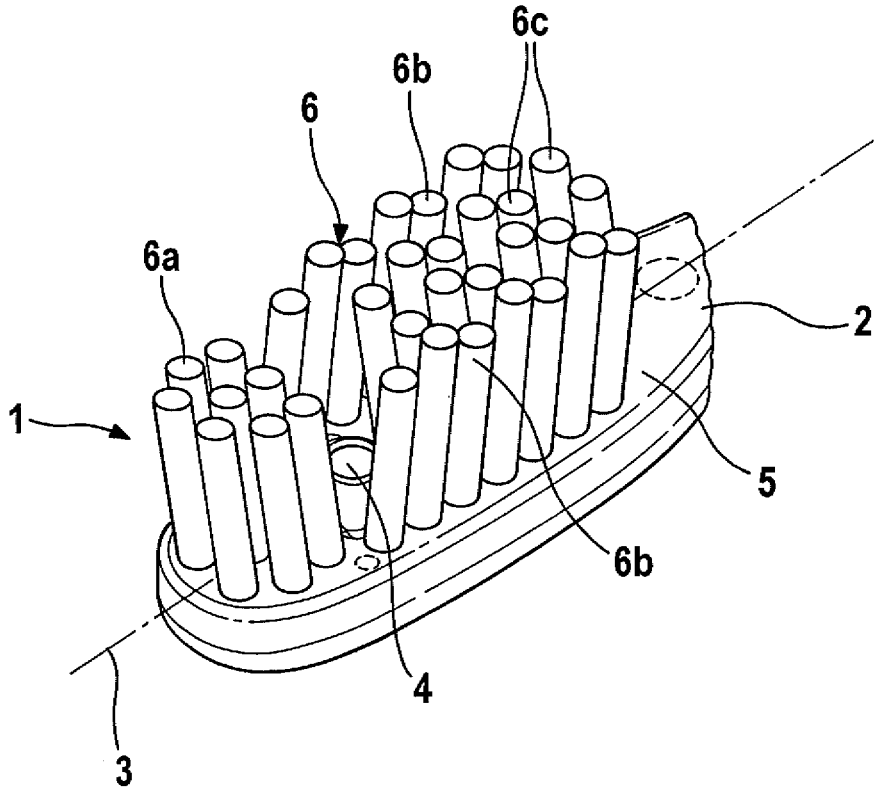
FIG. 1 is a perspective view of a bristled head of a toothbrush according to the invention.

An advantageous aspect of the invention has revealed that a minimum distance x or y of between about 0.5 and about 2.5 mm between a bottom of a blind-end hole provided for the insertion of bristle tufts and the rear side of the head enables a thinner toothbrush head to be provided which affords more comfortable handling in the mouth. If, in addition, the cross-sectional areas within the head between the bottoms and the rear side differ significantly from blind-end hole to blind-end hole, thus resulting in a more complex structure, it is of importance that in the transition area between the bottom of the blind-end hole and the sidewalls of the blind-end hole a chamfer or radius is provided, because this enables the injection molding to reach a higher level of perfection. In this arrangement, there are few or no restrictions to the small size of the bottom provided that the chamfered or radiused area rendering the blind-end hole smaller becomes correspondingly larger to form nearly a bottom.

Considered as cross-sectional area between bottom and rear side of the head is a section through the head which cuts across the blind-end hole and forms a plane arranged at right angles to the toothbrush longitudinal axis. Conventionally, the toothbrush longitudinal axis extends from the head end to the handle end of the toothbrush or, depending on the overall geometry, at least from the beginning of the head adjacent to the neck portion to the end of the head. Differences in the cross-sectional area or in the wall thicknesses of the injection molding may be attributable to recesses and cavities in the injection molding, undercuts or different configurations of the blind-end holes relative to each other. Of course, similar problems for the sides of the head or the brushing side or other portions of the toothbrush should be remedied in a similar way.

In a further advantageous aspect, the minimum distance x and y between the bottom and the rear side of the head is fixed to between about 0.8 and about 2 mm. Particularly when the length of the blind-end holes and thus the depth of the bottom or the distance to the rear side are fitted to suit each other in such a way that in a complex head structure wall thicknesses of approximately uniform magnitude result, uniform cooling in the molding after the injection-molding process and with it uniform shrinkage are ensured. Sunk spots at locations where major amounts of material have accumulated can thus be avoided. When this minimum distance x and y is in the range of between about 0.5 and about 2.5 mm or about 0.8 and about 2 mm between the bottom and the rear side for all or the majority of the blind-end holes of the head, it is possible that, depending on how the inner structure of the head is otherwise designed, the material thicknesses in the head are still sufficiently uniform, in spite of an inhomogeneous inner structure, in order to be able to obtain a visually desirable injection-molded product.

In a further advantageous aspect, provision is made for third and fourth blind-end holes which can be tufted with bristles to the same depth, with the third and fourth blind-end holes being constructed such that their bottoms extend to different depths. This makes it possible for the tufting depth of the tufts to be alike in the third and fourth blind-end holes while yet providing, due to different levels of depth, compensating chambers to compensate for material accumulations and the attendant material shrinkage problems.

In yet another advantageous aspect, the chamfer or radius in the fourth blind-end hole is followed by a constriction (opposite the sidewall lying above) and an adjoining further radius or chamfer and only then by the closing bottom. This enables the constriction to remain devoid of bristle tufts which affords, as set forth in the foregoing, a largely uniform tufting depth and hence a simplified manufacturing process.

In still another advantageous aspect, the head has a first interior region and a second interior region, with the first interior region being made of hard plastic and the second interior region including an electrically operable function element or part thereof. The head thus includes an inhomogeneous, rugged inner structure, with the second interior region requiring the provision of cavities in the molding of the first interior region. These cavities to be provided in the head in addition to the blind-end hole geometries result in added complexity, causing the flow areas of the liquid plastic to be severely narrowed, with many angles and boundaries and undercuts during the injection-molding operation in the die. Furthermore, the second interior region defines maximum material thicknesses which prescribe a certain cooling period for the plastic molding.

An injection point for the hard plastic of the head may be provided on the neck or on the handle portion, and the blind-end holes are spaced at different relative axial distances to the injection point on the head, with provision being made in the hard plastic of the head for a free space for the function element between these blind-end holes spaced at different relative distances. Blind-end holes may be thus provided both in the injection direction before, and in the injection direction after, the free space or cavity for the function element. In addition, blind-end holes may also be provided laterally or above the cavity, causing the complexity of the inner structure to be enhanced still further and making it necessary to take into account the material thicknesses or measures against undesired shrinkage effects closely.

The head may include at least one fifth blind-end hole which is arranged adjacent to and above the function element or above the free space or above the second interior region and is shorter than the third and fourth blind-end holes. Hence the blind-end hole depth can be reduced at those locations in the head where the free space is correspondingly limited by other cavities for the formation of blind-end holes. In an alternative embodiment, all the blind-end holes are reduced to this dimension at a uniform depth from the brushing side of the head into the head interior.

The rear side of the head may be made of the same hard plastic as the brushing side. This does not preclude injection molding the head at other locations using the two-component or multi-component injection molding technique, for example, when it is desired to have elastomer elements molded on in the brushing area. However, the rear side remains preferably at least in part devoid of a second plastic component which, while it may conceal visual defects on the molding on the one hand, adds to the thickness of the head on the other hand.

The head may be formed of a hard plastic material which exhibits more than about 1% material shrinkage after the actual injection-molding operation. Rather than selecting a different hard plastic, which is likewise conventional for the injection molding of toothbrush bodies but entails other disadvantages, for solving the material shrinkage problems which may produce visual defects already from about 1% material shrinkage, it may be desirable to match the inner structure of the head to the demands of material shrinkage.

The head may be formed of polypropylene (PP hard plastic). Polypropylene usually has about 2% material shrinkage after the injection-molding process. The head may also be formed of polyethylene, POM, SAN or copolyester hard plastic.

The head may include first and second bristle tufts of different lengths from the bottom of the blind-end hole to the bristle end spaced from the brushing area of the head, with the first and second bristle tufts being of approximately equal length from the brushing side to the bristle end. Alternatively, the first and second bristle tufts are of different lengths from the brushing side to the bristle end.

The head may include at least one blind-end hole having its central axis arranged at an angle to the perpendicular on the brushing side. Hence the head may include blind-end holes or tufting holes which extend at an inclination therein and are thus able to receive bristle tufts emerging from the head angularly. Angled bristle tufts enhance the cleaning performance of the bristles on the tooth, in which case however the angled blind-end holes may lead to increased turbulence of the liquid plastic in the die of the molding to be produced, in particular on staggered angled arrangements.

FIG. 1 shows in a perspective representation the head of a manual or electric toothbrush. The neck portion of the toothbrush adjoins the breakaway line 2 and is not shown in the Figures. Arranged in longitudinal continuation of the neck portion along the longitudinal axis 3 is a handle portion of the toothbrush in which electrical components are received according to the present embodiment in order to supply an electrically operable function element in the head with energy and the corresponding electrical components. For this purpose, the handle portion and the neck portion are provided preferably with cavities in the interior. In the present case, the electrically operable function element is preferably an LED arranged in protruding fashion on the brushing side 5 of the head within the bristle tufts 6. According to the present embodiment, the brushing side 5 is preferably of planar construction. Arranged on the brushing side are front cleaning bristles 6*a* positioned adjacent to the distal end of the head 1. The front cleaning bristles 6*a* are aligned forwardly at an angle to the longitudinal axis 3 so that the posterior wisdom teeth can be reached particularly well. The bristle zone includes furthermore two outer rows of bristle tufts 6*b* which according to the present embodiment are arranged at an inclination to the handle portion. Provided between these outer rows of bristle tufts 6*b* are two center bristle rows having bristle tufts 6*c* arranged at an inclination towards the distal end of the head 1. It will be understood that the toothbrush may include any other bristle configurations or oral care elements in combination with bristle tufts 6.

Figure 3:
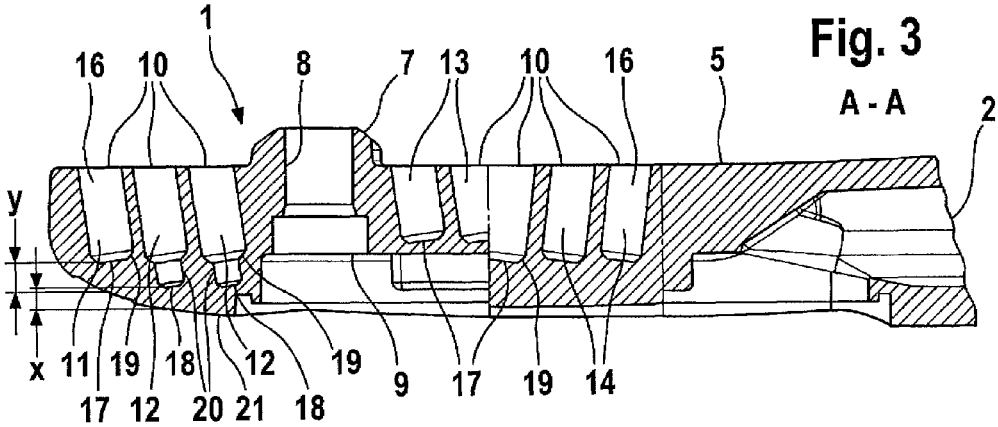
FIG. 3 is a longitudinal sectional view taken along the line A-A of FIG. 2.
Figure 2:
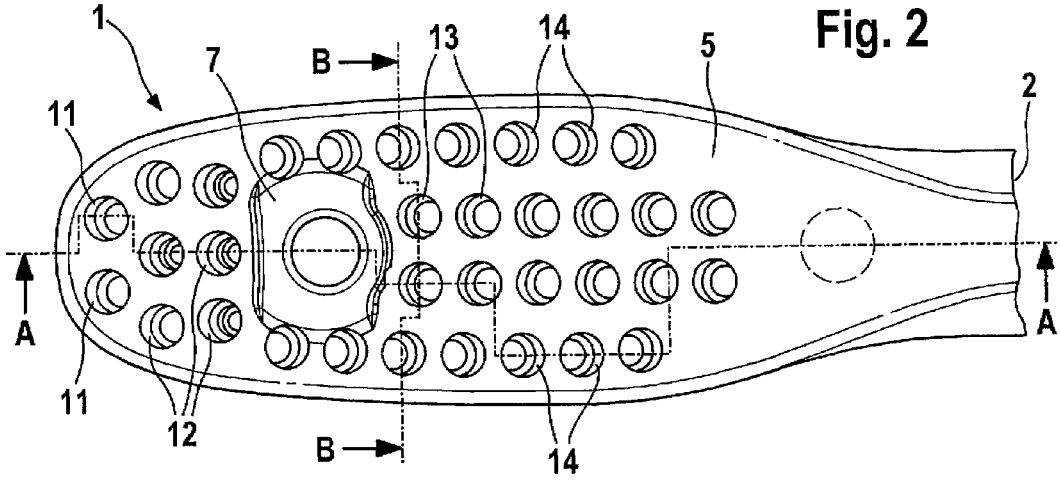
FIG. 2 is a top plan view of the head of FIG. 1, shown devoid of bristles.
Figure 4:
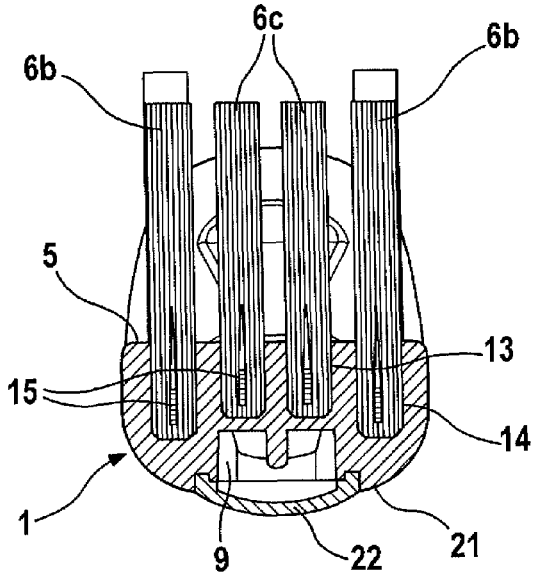
FIG. 4 is a cross-sectional view taken along the line B-B of FIG. 2, but with the bristles shown attached to the head.

FIG. 2 shows a top plan view of the head and hence the brushing side 5 of the toothbrush. FIG. 3 shows a longitudinal section along the line A-A of FIG. 2, and FIG. 4 shows a cross-section along the line B-B of FIG. 2. The bristle tufts 6 are not shown in FIGS. 3 and 2. In FIG. 4 the bristle tufts have been added. Provided in the front half of the head 1 is a ramp 7 or, alternatively, for example, an elastomer element which surrounds the LED 4. The associated cable connections are not shown in FIGS. 2, 3 and 4. The LED is inserted into the mounting hole 8 within the ramp 7 or the elastomer element. Adjoining in the interior of the head is a free space 9 or cavity 9 for the electrical leads to be provided for the electrically operable function element (here LED). The molding of the head 1 includes corresponding recesses for this free space.

As becomes apparent in particular from FIG. 3, blind-end holes 11, 12, 13 and 14 are provided for receiving the bristle tufts 6*a* through tufting apertures 10. The blind-end holes are tufted with bristle tufts, which in turn are comprised of a multiplicity of bristles or filaments, using the method referred to as anchor tufting (also called stapling technique). In this process, an anchor 15 (see FIG. 4) is driven centrally into a bristle tuft in a manner known in the art, said anchor seating itself in the hard plastic of the head to thereby ensure a secure fastening of the bristle tufts 6 in the head. The blind-end holes 11, 12, 13 and 14 have respective sidewalls 16 which form the lateral boundary surfaces for the bristle tufts in the blind-end holes. In combination with the sidewalls 16, the blind-end holes thus define as a rule a cylindrical body. Bottoms 17 and 18 are provided to limit the blind-end holes in downward direction in the interior of the head 1. The sidewalls 16 are connected with the bottoms 17 through chamfers or radiuses which ultimately form a conically tapering or frusto-conical section in the blind-end hole.

According to this embodiment, the head 1 has blind-end holes 11, 13 and 14 which have their sides bounded exclusively by the sidewalls 16, the adjoining chamfers or radiuses 19 and the bottoms 17. The tufting depth of the bristle tufts within the blind-end holes 11, 13 and 14 extends to roughly the bottoms 17. Unlike the other blind-end holes, the blind-end holes 12 are provided with constrictions 20, so that the following structure results for these blind-end holes. Adjoining the tufting apertures 10 of the blind-end holes 12, sidewalls 16 begin to extend into the depth of the head 1, which sidewalls continue downwardly in a chamfer or radius 19 which, similar to the other blind-end holes, is of a conically or frusto-conically tapering configuration.

Adjoining the chamfer or radius 19 further into the depth is a constricted portion 20 which in this case is likewise hollow, cylindrical, but of a smaller diameter than that defined by the sidewall 16. This constricted portion continues in a further chamfer or radius which connects the constriction with the bottom 18 of the blind-end holes 12. The constriction may also be formed by other geometries, as, for example, the frustum of a cone, a cone, a taper or curved surfaces.

Unlike the other blind-end holes, the blind-end holes 12 are not tufted down to the bottom but only as far as the first chamfer or radius 19 which is located at approximately the same level of depth as the chamfer or radius 19 of the adjacent blind-end holes 11. In consequence, the front group of bristle tufts 6*a* of the head 1 extends to a uniform tufting depth in the head 1, which simplifies the manufacturing process.

The purpose of the constriction 20 is to help prevent sunk spots from developing due to material shrinkage which would occur in the absence of such a constriction on material accumulation in the area of cross-section of the head on the rear side, because shrinkage is reduced owing to the lower amount of material accumulation and a shortened cooling period of the plastic material subsequent to the injection-molding operation. The vertical extension of the lowermost point of the bottom of the blind-end holes to the outer surface of the rear side 21 of the head defines the minimum distances x and y, respectively (see FIG. 3).

According to the present embodiment, the minimum distance x between the lowermost point of the blind-end hole 12 and the rear side 21 is about 1 mm, approximately. A minimum distance of between about 1.2 and about 1.6 mm, approximately, is predetermined at y between the lowermost point of the blind-end hole 11 and the rear side 21 directly thereunder. Advantageously, this distance varies for all the blind-end holes of the head between about 0.5 and about 2.5 mm or between about 0.8 and about 2 mm. Because these areas can be at different distances from the injection point, it may be appropriate to provide different distances between the lowermost bottoms of the blind-end holes and the rear side of the head.

The blind-end holes 14 have likewise the same tufting depth for the bristle tufts as the blind-end holes 11 and 12. The blind-end holes 14 are arranged laterally next to the cavity or free space 9. The blind-end holes 13 extend into the head less deeply than the other blind-end holes. Extending further deeply adjacent to the blind-end holes 13 is the cavity 9 (see in particular FIGS. 3 and 4).

As becomes apparent particularly from FIG. 1, the length of the bristle tufts from the bottom of the blind-end holes to the bristle ends in the cleaning area is not predetermined by the depth of the blind-end holes. The topography nevertheless identifiable from FIG. 1 with height differences in the bristle tuft ends is determined after insertion of the bristle tufts in the blind-end holes by cutting the bristle ends to length and endrounding them subsequently. Thus, as illustrated in FIG. 4, bristle tufts 6*b* and 6*c* are provided in the head which are of equal length between the brushing side 5 and the bristle ends but extend to different depths in the blind-end holes of the head, so that the overall lengths of the bristle tufts differ in spite of like end height.

As becomes apparent in particular from FIG. 4, the cavity 9 is closed tight by an end cover 22. The end cover 22 is not shown in FIG. 3. The subject-matter of this application can be used to advantage regardless of the construction of an end cover 22 or cavities 9 in the head. The provision of a cavity 9 in addition to the blind-end holes increases however the inner complexity of the head 1 so that material shrinkage and visual flawlessness in the injection-molding process are not achievable with the known approaches. As becomes additionally apparent from FIGS. 3 and 4, sections are provided in vertical extension below the bristle tufts on the rear side 21 of the head 1 which are not in alignment with the cavity 9 or the cover 22, so that particularly at these locations sunk spots due to material shrinkage could develop in the absence of the measures herein described.

According to this embodiment, the head is injection-molded from a plastic component made of hard plastic, namely polypropylene. The injection point for the molding in the die may be located in the neck or handle portion of the toothbrush. Alternatively, the injection point is provided in the head. In the absence of a further plastic component or in particular soft plastic component on the rear side 21 of the head 1, this embodiment provides no concealing of any visual flaws in the head left by the injection-molding process. Depending on the type of visual flaw, concealing it by overcoating the visually objectionable areas may not be possible or practical.

The method of manufacturing the toothbrush is composed of the following process steps: Injection-molding of at least the plastic head, where applicable, together with the neck or handle portions, using in particular polypropylene or other materials. The bristle tufts 6 are inserted in the head and anchors are driven into the head to secure the bristle tufts. The end sections of the bristle tufts 6 are finished by cutting the bristle tufts 6 to the proper length or topography, by endrounding them and applying further finishing steps, where appropriate. In cases where the electrically operable function element (here LED) is not cast integrally with the head in the prior injection-molding process, mounting of this element in the head takes place subsequent to the above tufting steps.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A toothbrush having a handle portion and a neck portion connecting the handle portion with a head, said head having a brushing side and a rear side opposite thereto, said brushing side including a plurality of bristle tufts for cleaning the teeth, said tufts being attachable in the head through tufting apertures using an anchor, with each tufting aperture being assigned a blind-end hole having sidewalls and a bottom, wherein provision is made for a chamfer or radius in the transition area between the bottom and the sidewalls, with a cross-sectional area of the head between a first bottom and the rear side differing from a cross-sectional area of the head between a second bottom and the rear side, and said first bottom and said second bottom being arranged in the head in such a way that the minimum distance y between the first bottom and the rear side as well as the minimum distance x between the second bottom and the rear side are each in the range of between about 0.5 and about 2.5 mm.

2. The toothbrush according to claim 1, wherein the first and the second bottom are arranged in the head in such a way that the minimum distance x and y amounts to between about 0.8 and about 2 mm each.

3. The toothbrush according to claim 1, wherein the head includes third and fourth blind-end holes which can be tufted with bristle tufts to the same depth, said third and fourth blind-end holes being constructed such that their bottoms extend to different depths.

4. The toothbrush according to claim 3, wherein the fourth blind-end hole the chamfer or radius is followed by a constriction and an adjoining further radius or chamfer and thereafter by the adjoining bottom.

5. The toothbrush according to claim 1 wherein the head has a first interior region and a second interior region, said first interior region being made of hard plastic and said second interior region including an electrically operable function element or part thereof.

6. The toothbrush according to claim 5, wherein an injection point for the hard plastic of the head is provided on the neck or on the handle portion and that the blind-end holes are spaced at different relative axial distances to the injection point on the head, and that in the hard plastic of the head a free space is provided for the function element between said blind-end holes spaced at different relative distances.

7. The toothbrush of claim 1, wherein the head includes at least one fifth blind-end hole which is arranged adjacent to and above the function element and is shorter than the third and fourth blind-end holes.

8. The toothbrush of claim 1, wherein the rear side of the head is made at least in part of the same hard plastic as the brushing side.

9. The toothbrush of claim 1, wherein the head is formed of a hard plastic material which exhibits more than 1% material shrinkage after an injection-molding operation.

10. The toothbrush of claim 1, wherein the head is formed of polypropylene hard plastic.

11. The toothbrush of claim 1, wherein the head is formed of polyethylene, POM, SAN or copolyester hard plastic.

12. A toothbrush having a handle portion and a neck portion connecting the handle portion with a head, said head having a brushing side and a rear side opposite thereto, said brushing side including a plurality of bristle tufts for cleaning the teeth, said tufts being attachable in the head through tufting apertures using an anchor, with each tufting aperture being assigned a blind-end hole having sidewalls and comprising a first portion having a first bottom and a second portion having a second bottom, wherein the first portion is longer and wider than the second portion, and wherein provision is made for a chamfer or radius in the transition area between the first bottom and the sidewalls, with a cross-sectional area of the head between the first bottom and the rear side differing from a cross-sectional area of the head between the second bottom and the rear side, and said first bottom and said second bottom being arranged in the head in such a way that the minimum distance y between the first bottom and the rear side as well as the minimum distance x between the second bottom and the rear side are each in the range of between about 0.5 and about 2.5 mm.

* * * * *